US005785018A

United States Patent [19]

Schebitz

[11] Patent Number: 5,785,018

[45] Date of Patent: Jul. 28, 1998

[54] ADJUSTABLE DEVICE FOR CAM-CONTROLLED VALVE OPERATION OF A PISTON-TYPE INTERNAL COMBUSTION ENGINE

[75] Inventor: Michael Schebitz, Eschweiler, Germany

[73] Assignee: FEV Motorentechnik GmbH & Co KG, Germany

[21] Appl. No.: 747,595

[22] Filed: Nov. 12, 1996

[30] Foreign Application Priority Data

Nov. 9, 1995 [DE] Germany ..... 295 17 755 U

[51] Int. Cl.[6] ..... F01L 1/344

[52] U.S. Cl. ..... 123/90.17; 123/90.31; 74/568 R; 464/2; 464/160

[58] Field of Search ..... 123/90.15, 90.17, 123/90.31; 74/567, 568 R; 464/1, 2, 160

[56] References Cited

U.S. PATENT DOCUMENTS

| | | | |
|---|---|---|---|
| 2,682,260 | 6/1954 | Lantz | 123/90.17 |
| 4,754,727 | 7/1988 | Hampton | 123/90.17 |
| 4,934,348 | 6/1990 | Yagi et al. | 123/90.16 |
| 5,097,804 | 3/1992 | Brune et al. | 123/90.17 |
| 5,381,764 | 1/1995 | Fukuma et al. | 123/90.17 |

*Primary Examiner*—Weilun Lo

*Attorney, Agent, or Firm*—Spencer & Frank

[57] ABSTRACT

An adjustment device for a cam-controlled valve operation in a piston-type internal combustion engine includes a camshaft adapted for actuating intake or exhaust valves of the piston-type internal combustion engine. The camshaft has a camshaft axis and includes an end having a guide surface. A transmission element constituting a magnetic armature is arranged for being moved back and forth in a direction of the camshaft axis. The transmission element includes an inner guide element opposite from and corresponding to the guide surface and a carrier element at a radial distance from the inner guide element that meshes with a corresponding carrier surface on a drive wheel, and is positioned for being twisted coaxially and relative to the camshaft. At least one of the guide surface on the camshaft and the carrier surface on the drive wheel is aligned in a helical shape relative to the camshaft axis. A stationary, switchable magnet has a pole surface facing the transmission element and presents a magnetic force that attracts the transmission element toward the pole surface when the magnet is switched on. A restoring mechanism is arranged along the camshaft and presents a force urging the transmission element away from the pole surface. A limit stop is disposed on the camshaft for holding the transmission element at a short distance from the pole surface of the magnet and counter to the force of the restoring means when the magnet is switched on.

12 Claims, 2 Drawing Sheets

ADJUSTABLE DEVICE FOR CAM-CONTROLLED VALVE OPERATION OF A PISTON-TYPE INTERNAL COMBUSTION ENGINE

CROSS-REFERENCE TO RELATED APPLICATIONS

The right of priority is claimed herein with respect to German application No. 295 17 755.1 filed in Germany on Nov. 9, 1995, the disclosure of which is incorporated herein by reference.

BACKGROUND OF THE INVENTION

It is possible to adjust the operating conditions of piston-type internal combustion engines with cam-controlled valve operation by changing the opening and closing times of the intake and/or exhaust valves. The problem with this is that the regulating energy of the stationary regulating part must be shifted to the rotating part that is connected to the camshaft.

In order to transfer the regulating energy from the stationary to the rotating system, U.S. Pat. No. 2,682,260 discloses a mechanical system in which a sleeve with two helical slits is arranged at the free front end of the camshaft, into which an adjustment sleeve with corresponding cams that lock into the guide slits engages. The adjustment sleeve is connected so that it does not rotate with the gearwheel that drives the camshaft, but can be moved back and forth in the axial direction with the aid of a compound lever arrangement. Depending on the position of the adjustment sleeve, the gearwheel in its phase position is thus turned by a respective angle relative to the camshaft. In order to transfer the axial regulating power from the compound lever arrangement to the adjustment sleeve, a pressure pin is connected to the compound lever arrangement, which pin is arranged coaxially to the adjustment sleeve and is connected to the latter via a bearing, so that the shifting power can be transferred from the stationary compound lever arrangement axially to the adjustment sleeve, which is connected non-rotatingly to the camshaft and rotates with it. The compound lever arrangement can be moved respectively to one or the other switching positions via a hydraulic piston/cylinder unit.

An adjustment device is also disclosed in U.S. Pat. No. 4,934,348 where a transmission element provided between the camshaft and the drive wheel, is connected, respectively, via a toothing to the drive wheel and to the camshaft and which moves as a sealed piston inside the drive wheel so that when the piston front is admitted with oil pressure, the transmission element can be moved in the axial direction with respect to the camshaft. Since at least one of the toothings is designed as a spiral or helical toothing, a relative twisting between drive wheel and camshaft is effected when the transmission element designed as a piston is admitted with a pressure. However, the adjustment energy made available by the oil pressure or oil volume must in this case also be transferred from the stationary to the rotating system, so that an expensive seal must be provided between the stationary and the rotating parts. In addition to this cost factor, a hydraulic system has the disadvantage that the piston-type internal combustion engine must provide the necessary oil pressure through its oil circulation, so that all shifting operations for actuating the hydraulic adjustment device represent an intervention in the oil circulation system, which is very sensitive in modern-type engines.

SUMMARY OF THE INVENTION

It is an object of the invention to create an adjustment device of the above type which can be produced at low cost and which can also be installed without considerable expenditure on already existing crankcases or cylinder heads.

The above and other objects are accomplished according to the invention by the provision of an adjustment device for a cam-controlled valve operation in a piston-type internal combustion engine, comprising: a camshaft adapted for actuating valves of the piston-type internal combustion engine, the camshaft having a camshaft axis and including an end having a guide surface; a transmission element constituting a magnetic armature and arranged for being moved back and forth in a direction of the camshaft axis, the transmission element including an inner guide element arranged opposite from and corresponding to the guide surface at the end of the camshaft, and a carrier element at a radial distance from the inner guide element that meshes with a corresponding carrier surface on a drive wheel, the transmission element being arranged for being twisted coaxially and relative to the camshaft, wherein at least one of the guide surface and the carrier surface is aligned in a helical shape relative to the camshaft axis; a stationary, switchable magnet having a pole surface facing the transmission element and presenting a magnetic force that attracts the transmission element toward the pole surface when the magnet is switched on; a restoring means arranged along the camshaft and presenting a force urging the transmission element away from the pole surface; and a limit stop disposed on the camshaft for holding the transmission element at a short distance from the pole surface of the magnet and counter to the force of the restoring means when the magnet is switched on.

Accordingly, the solution according to the invention is that a fixed, switchable magnet is arranged so that it has a pole surface facing the transmission element in the form of a magnetic armature and a limit stop is provided on the camshaft which, if the magnet is activated, holds the transmission element a short distance away from the pole surface, against the force of the restoring means. Such a magnetic regulating device transmits its magnetic adjustment energy via an air gap from the stationary to the rotating system. As a result of this arrangement, expensive seals as well as costly bearings for the transmission element are unnecessary. In the simplest case, the control of the magnetic adjustment energy can be realized with a switch. For piston-type internal combustion engines with an electronic motor control, the adjustment device is adjusted either to the "early" or the "late" position, depending on the existing performance diagram for the adjustment device and various signals input to the electronic control, including motor speed and a load signal. The load signal depends on the desired load selected by the driver, meaning the gas pedal position and is generated by a signal transmitter receiving the gas pedal position directly from the gas pedal or by a signal transmitter detecting the throttle valve angle. Since the switchable magnet is installed stationary, the adjustment energy can be supplied in a simple way. Depending on the drive and with the magnet switched off, the transmission element is held against one of the limit stops by the restoring means. If the magnet is switched on, the transmission element, designed as magnetic armature, is held in the other regulating position, a short distance from the pole surface of the magnet, wherein the retention force is tramsmitted via the air gap between the pole surface of the magnet and the transmission element/armature. If the magnet is switched off, the transmission element is returned to the other position by the force of the restoring means. As a result of this axial movement of the transmission element, the required relative twisting between drive wheel and camshaft is effected in each case in one direction or the other via the helical guide surfaces and/or carrier surfaces and the corresponding elements on the transmission element.

In accordance with one embodiment of the invention, the switchable magnet can be formed by a switchable permanent magnet arrangement, which can be actuated via mechanical, pneumatic, hydraulic or even electric regulating means, wherein the regulating means here can also be triggered via the motor control. Such switchable permanent magnet arrangements are known, for example, as holding magnets. In another embodiment, the switchable magnet is designed as electromagnet, which is connected to a device that controls the current supply.

One preferred embodiment of the invention provides that if the transmission element or the camshaft are provided with a spiral toothing with respectively corresponding counter-elements, the pitch of the toothing is adjusted to the course of the magnetic force in dependence on the distance between the pole surface and the transmission element. This makes it possible to compensate for the still low magnetic force when the distance between pole surface and transmission element is great, by adapting the pitch so that at the start of the switching operation it is necessary to transmit only a small regulating power and toward the end of the switching operation a high regulating power can be transmitted over a correspondingly long regulating path. It is advisable to achieve this by permitting the pitch of the helical surfaces, regardless of whether they are designed either as toothing or as simple guide surfaces, to decrease in the direction of the pole surface, so that with increasing approach of the transmission element to the pole surface, a stronger relative twisting between drive wheel and camshaft takes place. It is useful here if the course of the helical surfaces is such that starting with the final position of the transmission element with the magnet switched off, the angle of pitch is pointing counter to the rotational direction of the camshaft. As a result of this and when switching off the magnet, it is possible to cause the transmission element to be turned back to the other final position through the driving moment of the driving wheel, in particular for embodiments with increasing pitch. The surfaces with pitched design here assume simultaneously the function of a restoring means. However, it is advisable to provide additionally a spring element as restoring means.

In one useful embodiment of the invention, it is further provided that a buffering element is arranged between the transmission element and the magnet. This buffers the impact when the transmission element hits the limit stop because its kinetic energy increases as a result of the increase in the magnetic power with increasing approach of the transmission element, designed as a magnetic armature, to the pole surface.

In accordance with another advantageous embodiment of the invention, an electromagnet is provided as a main magnet and a switchable permanent magnet as a holding magnet. This arrangement has the advantage that by way of the electromagnet, the large force required to displace the transmission element toward the pole surface can be effected by a correspondingly designed electromagnet that can be energized with a correspondingly strong current, which moves the transmission element reliably and briefly to the limit stop. In order to reduce the current consumption in this case, which must be generated by the generator of the associated piston-type internal combustion engine, the holding power that is much lower due to the small air gap can now be applied via the switchable permanent magnet. Thus, as soon as the transmission element is moved to the limit stop by the electromagnet, the current supply for the electromagnet can be switched off after the permanent magnet is switched on.

The permanent magnet can also be arranged in the transmission element, so that the holding power that is to be applied via the permanent magnet becomes effective without additional switching operations as soon as the transmission element rests against the limit stop at the pole surface. However, for detaching of the transmission element, it then becomes necessary to reverse the electromagnet poles by supplying current in the opposite direction and to "repel" the transmission element through a correspondingly strong opposing field, so that under the additional effect of the restoring means, the transmission element can be returned to its starting position at a correspondingly long distance from the pole surface of the electromagnet.

Another design version according to the invention provides that the control device for embodiments with only one switchable electromagnet is designed such that when the transmission element comes to rest against the limit stop surface, the current is reduced so that the electromagnet is activated during this holding phase only with a current level necessary to hold the transmission element against the limit stop. With this measure as well, it is possible to reduce the current consumption and thus relieve the generator of the piston-type internal combustion engine. If necessary, the holding current can also be clocked during the holding phase between a lower minimum holding current and a somewhat higher maximum holding current, so that the electromagnet is not supplied with current during the phases where the current drops from the upper holding current to the lower holding current. The residual magnetism during the current drop here is sufficient to maintain the holding force.

The invention is explained in more detail below with the aid of the accompanying drawings.

DETAILED DESCRIPTION OF THE INVENTION

Figures 1, 3:
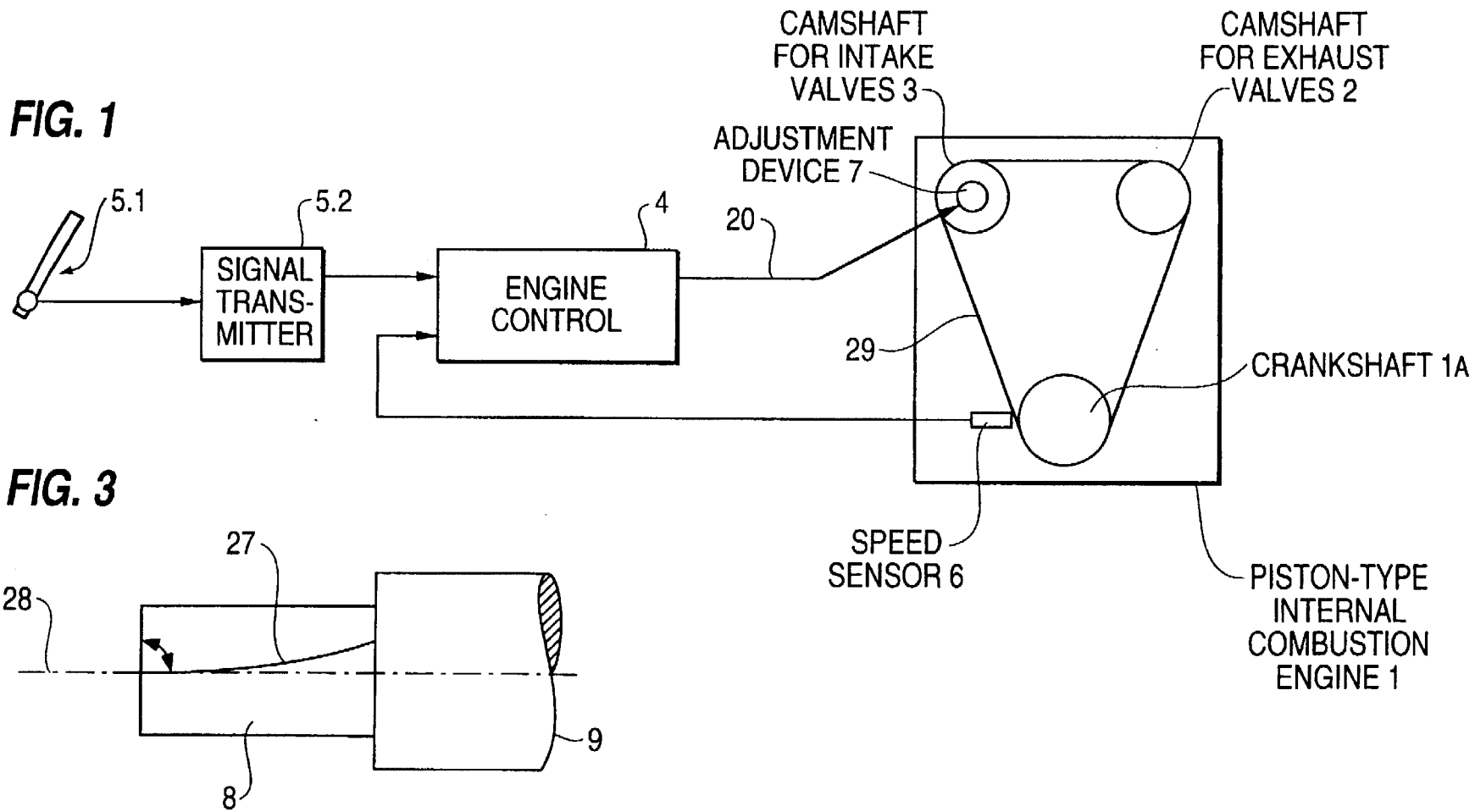
FIG. 1 shows a piston-type internal combustion engine with its control in the form of a block diagram.
FIG. 3 is a representation of the course of the toothing pitch between camshaft and transmission element according to the invention.

The block diagram according to FIG. 1 shows a piston-type internal combustion engine 1 with one above-installed camshaft 2 for the exhaust valves and one above-installed camshaft 3 for the intake valves. An electronic engine control device 4, to which a desired load is supplied as a regulating signal via a gas pedal 5.1 controls the piston-type internal combustion engine 1. The regulating signal can be tapped either directly at the gas pedal via a corresponding signal transmitter 5.2 as shown here, or from the position of a butterfly valve via a signal transmitter which generates a corresponding desired load signal. A corresponding engine speed signal is supplied to engine control 4 from an engine speed sensor 6 associated with the crankshaft 1A.

For the illustrated exemplary embodiment, camshaft 3 for actuating the intake valves has an adjustment device 7 that permits changing the opening time for the intake valves between an "early opening" time and a "late opening" time, depending on the desired load and the engine speed. It would of course also be possible to trigger exhaust valves 2 in the same way.

Figure 2:
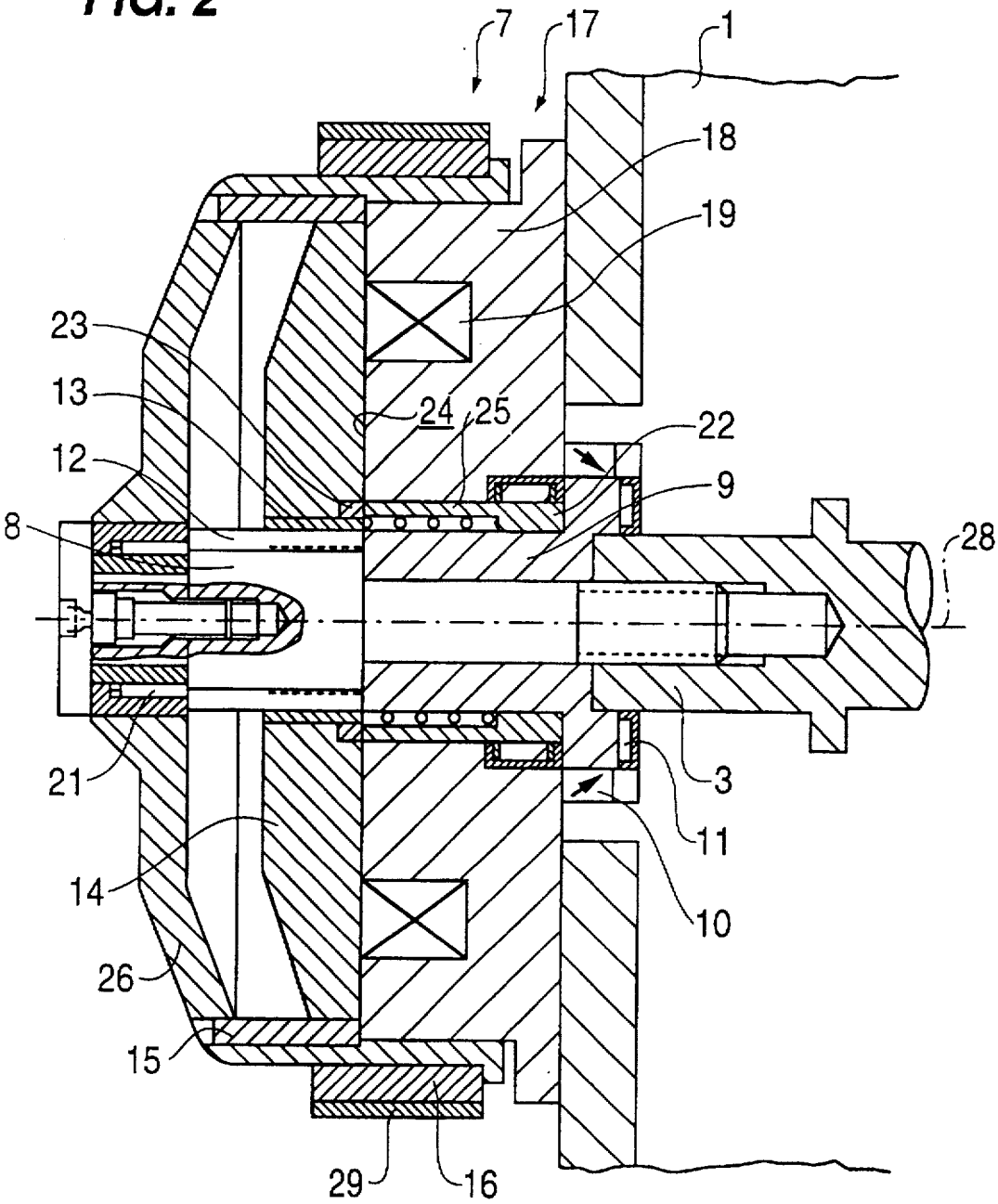
FIG. 2 is a cross section of an adjustment device according to the invention.

FIG. 2 is a representation in a cross section of an exemplary embodiment of an adjustment device 7 according to the invention. Camshaft 3 actuates the intake valves and is rigidly connected with an extension in the form of a serrated shaft 8. A sleeve 9 is arranged on serrated shaft 8 so that it cannot be turned, and serves to receive a sealing ring 10 and to function as a limit stop for an axial bearing 11. Axial bearing 11 absorbs in the axial direction a force resulting from a relative adjustment of the rotational angle between camshaft 3 and a drive shaft (not shown in detail) that is drivingly connected with camshaft 3 by a toothed belt 29 or a chain.

According to one embodiment of the invention, serrated shaft 8 is provided with a helical toothing 12 which engages with a corresponding radially inner helical toothing 13 of transmission element 14. Transmission element 14 is designed as a magnetic armature in the exemplary configuration shown in FIG. 2. For example, this can be effected by producing transmission element 14 from a ferromagnetic material. If a non-ferromagnetic material is selected for transmission element 14, for example for reasons of wear, then a respective ferromagnetic material must be inserted into the transmission element, also in the form of a permanent magnet.

At a radial distance to inner helical toothing 12, transmission element 14 has a toothing 15 on its outer circumference, for example a straight toothing, which can be moved axially inside a respective inner toothing of a drive wheel 16 having a pot-shaped configuration. Pot-shaped drive wheel 16 is driven via a chain or a toothed belt 29 (compare FIG. 1) via the crankshaft of the internal combustion engine.

The engine speed is transmitted to camshaft 3 via the meshed toothings of camshaft 3 and transmission element 14 on the one hand and the meshed toothings of transmission element 14 and drive wheel 16 on the other hand.

An electromagnet 17 is attached to the cylinder head for the internal combustion engine 1, which is essentially formed by a yoke 18 and a coil 19 embedded in the yoke. Coil 19 is connected via a corresponding signalling line 20 (FIG. 1) with engine control 4, so that coil 19 can be either supplied with current or not supplied with current, depending on the preset values for the engine control.

Pot-shaped drive wheel 16 is positioned with a bearing 21 at camshaft 3, so that drive wheel 16 can rotate freely relative to camshaft 3 and is fixed axially.

A stop sleeve 22 is connected rigidly with sleeve 9 that is connected rigidly to camshaft 3. Stop sleeve 22 cooperates with a corresponding limit stop 23 in transmission element 14. Stop sleeve 22 and limit stop 23 are dimensioned so that they hold transmission element 14 at a short distance from pole surface 24 of electromagnet 17 by maintaining a narrow air gap.

Since electromagnet 17 is connected stationary to piston-type internal combustion engine 1, the regulating power necessary for actuating (i.e. moving) transmission element 14 can be transmitted in a contactless manner. Depending on the requirements posed by engine control 4, transmission element 14 can be moved to the switching position shown in FIG. 2 by supplying power to electromagnet 17, or can be moved to another control position via a restoring means, for example in the form of a readjustment spring 25 and by concomitantly cutting off power to electro-magnet 17.

If coil 19 of electromagnet 17 is supplied with current via engine control 4, transmission element 14 is held in the illustrated switching position at only a short distance from pole surface 24, so that camshaft 3 is driven in its predetermined phase position relative to the crankshaft via the toothed belt 29, drive wheel 16 and transmission element 14.

Since toothing 12, 13 between camshaft 3 and transmission element 14 is designed as helical toothing, and toothing 15 between transmission element 14 and drive wheel 16 can either be designed as straight toothing or as corresponding helical toothing, transmission element 14 is pushed via the restoring means, for example in the form of spring 25, against a lid-type end 26 of drive wheel 16 when coil 19 is not supplied with current. As a result of this, drive wheel 16 is twisted relative to camshaft 3 via the helical toothing, so that the phase position of the cam on camshaft 3 relative to the crankshaft is also forced to change in a corresponding way.

If, as a result of supplying current to electromagnet 17, transmission element 14 is to be moved from the limit stop position at lid 26 of drive wheel 16 to the operating position shown in FIG. 2, then coil 19 must be energized with a relatively high current to generate the necessary magnetic force to move transmission element 14 in the direction of pole surface 24 to the illustrated switching position. Since the magnetic force acting upon transmission element 14 increases inversely proportional with distance, if coil 19 receives the same amount of current, it is useful if, for a straight toothing 15 between drive wheel 16 and transmission element 14, the helical toothing at the camshaft 3 or transmission element 14 is designed so that its pitch decreases in the direction toward the pole surface 24, as is shown diagrammatically in FIG. 3 for the tooth line 27. The opposing surface to the element with helical toothing in that case has corresponding guide cams, which permit the movement along the tooth line 27. The maximum angle of pitch here is given if it runs parallel to the longitudinal axis 28 of camshaft 3. This ensures that at the start of the current supply, transmission element 14 initially is moved only in the axial direction, so that only a friction resistance between the respective toothings must be overcome. Only after the magnetic force has increased correspondingly during the approach of transmission element 14 to pole surface 24, does the regulating power for a relative twisting between camshaft 3 and drive wheel 16 become effective at the same time.

If no current is supplied to electromagnet 17, transmission element 14 is separated from pole surface 24 and is returned to the other switching position as a result of the cooperation of restoring spring 25 and the axial component from the helical toothing, in cooperation with the driving moment provided by drive wheel 16.

Since a relatively high current must be supplied to magnet 17, which is designed as an electromagnet, in order to initiate a displacement of transmission element 14, while only a low amount of holding current is required for holding transmission element 14 in the "contact phase" with only a small air gap against pole surface 24, it is useful if the current supplied to coil 19 via engine control 4 is reduced to a point where the holding power of the electromagnet is sufficient to hold transmission element 14 in this position. This not only reduces the current consumption, but also reduces the "braking moment" between stationary electromagnet and the rotating transmission element, so that the resulting power losses are reduced as compared to being under full power. The reduction of the holding current can be achieved by keeping the holding current constant at a minimum level or even by a clocking between a minimum holding current and a slightly higher holding current. If the current supply is switched off once the higher holding current is reached and is switched on again only after the minimum holding current phase is reached, then no current is consumed in the meantime. As a result of the time-delayed reduction in the magnetic force caused by the residual magnetism, transmission element 14 nevertheless is held in its predetermined limit stop position a short distance from the pole surface 24.

In place of the illustrated magnet 17 which is designed as an electromagnet, it is possible to provide a switchable permanent magnet, which can be switched to an operating position that is magnetically effective toward the outside, by using a mechanical actuation through an internal magnetic short. Such a permanent magnet in its basic concept is, for example, known as a holding magnet.

It is also possible to combine such a switchable permanent magnet with an electromagnet so that the electromagnet functions as a main magnet for the movement of transmission element 14 and that the switchable permanent magnet functions as a holding magnet. This makes it possible to switch off the current supply for the electromagnet functioning as a main magnet during this holding phase, after the limit stop position has been reached, and that the activated permanent magnet holds transmission element 14 as the holding magnet. If transmission element 14 is to be transferred to the other switching position, the switchable permanent magnet is switched correspondingly to its short-circuit position, so that transmission element 14 can be moved back to the other switching position via the reverse torsion moment via restoring spring 25, as previously described.

When supplying a direct current to the electromagnet, which generates a rectified magnetic field, it is also possible to provide transmission element 14 with correspondingly poled permanent magnets, the forces of which, however, are directed such that they can generate the necessary holding power as soon as transmission element 14 is in its limit stop position opposite pole surface 24. The current for the electromagnet can then be switched off. If transmission element 14 is to be returned to the other switching state, electromagnet 17 must be supplied with current once more through a respective reversal of the current flow, so that for a correspondingly high magnetic field, the magnetic field for the permanent magnet at transmission element 14 is overcome and transmission element 14 is moved back to the other switching position by the return spring.

In the illustrated exemplary embodiment one toothing is provided, respectively, for the transmission of forces between drive wheel 16, transmission element 14 and camshaft 3. However, for the transmission of force and for guiding camshaft 3, it is also possible to provide one or several respective guide surfaces that mesh with respectively designed opposing guide elements in place of the toothing. Accordingly, in place of a toothing between the outer circumference of transmission element 14 and drive wheel 16, one carrier surface with coordinated carrier elements can be provided. The guide surfaces in this case can have a helical guide profile, so that this will also result in the necessary relative twisting between camshaft 3 and drive wheel 16 during an axial displacement of transmission element 14.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. An adjustment device for a cam-controlled valve operation in a piston-type internal combustion engine, comprising:

a camshaft adapted for actuating valves of the piston-type internal combustion engine, the camshaft having a camshaft axis and including an end having a guide surface;

a transmission element constituting a magnetic armature and arranged for being moved back and forth in a direction of the camshaft axis, the transmission element including an inner guide element opposite from and corresponding to the guide surface at the end of the camshaft and a carrier element at a radial distance from the inner guide element that meshes with a corresponding carrier surface on a drive wheel, the transmission element being arranged for being twisted coaxially and relative to the camshaft, wherein at least one of the guide surface and the carrier surface is aligned in a helical shape relative to the camshaft axis;

a stationary, switchable magnet having a pole surface facing the transmission element and presenting a magnetic force that attracts the transmission element toward the pole surface when the magnet is switched on;

a restoring means arranged along the camshaft and presenting a force urging the transmission element a way from the pole surface; and a limit stop disposed on the camshaft for holding the transmission element at a short distance from the pole surface of the magnet and counter to the force of the restoring means when the magnet is switched on.

2. The adjustment device according to claim 1, wherein the restoring means comprises at least one restoring spring which holds the transmission element at a considerable distance from the pole surface when the magnet is switched off.

3. The adjustment device according to claim 1, wherein the guide surface and the inner guide element comprise several pitched guide surfaces and several inner guide elements, respectively, that are each in the form of helical toothing.

4. The adjustment device according to claim 3, wherein the toothing between the transmission element and the camshaft is adapted to the course of the magnetic force, in dependence on the distance between the pole surface and the transmission element.

5. The adjustment device according to claim 3, wherein the helical toothing has a pitch that decreases in a direction of the pole surface.

6. The adjustment device according to claim 1, wherein the carrier guide elements comprise several pitched guide elements in the form of helical toothing for meshing with correspondingly shaped carrier surfaces on the driving wheel.

7. The adjustment device according to claim 6, wherein the toothing between the transmission element and driving wheel is adapted to the course of the magnetic force, in dependence on the distance between the pole surface and the transmission element.

8. The adjustment device according to claim 6, wherein the helical toothing has a pitch that decreases in a direction of the pole surface.

9. The adjustment device according to claim 1, further including a buffering element arranged between the transmission element and the magnet.

10. The adjustment device according to claim 1, wherein the magnet comprises an electromagnet and the adjustment device further includes a control device for controlling a feeding of current to the electromagnet.

11. The adjustment device according to claim 1, wherein the magnet comprises a switchable permanent magnet.

12. The adjustment device according to claim 1, wherein the magnet includes an electromagnet as a main magnet and a switchable permanent magnet as a holding magnet.

* * * * *